US006799000B2

(12) United States Patent
Aslam et al.

(10) Patent No.: US 6,799,000 B2
(45) Date of Patent: Sep. 28, 2004

(54) ROLLER FUSER SYSTEM WITH INTELLIGENT CONTROL OF FUSING MEMBER TEMPERATURE FOR PRINTING MIXED MEDIA TYPES

(75) Inventors: Muhammed Aslam, Rochester, NY (US); James Douglas Shifley, Spencerport, NY (US); Fangsheng Wu, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/215,884

(22) Filed: Aug. 9, 2002

(65) Prior Publication Data

US 2004/0028420 A1 Feb. 12, 2004

(51) Int. Cl.[7] ..... G03G 15/00; G03G 15/20

(52) U.S. Cl. ..... 399/45; 219/216; 399/67; 399/69

(58) Field of Search ..... 399/330, 338, 399/335, 45, 67; 219/216, 469, 470, 471

(56) References Cited

U.S. PATENT DOCUMENTS 5,049,906 A * 9/1991 Kobayashi et al. ..... 399/67
5,893,019 A * 4/1999 Yoda et al. ..... 399/321
6,411,785 B1 * 6/2002 Ogawahara et al. ..... 399/45
6,611,670 B2 * 8/2003 Chen et al. ..... 399/45
2002/0164172 A1 * 11/2002 Tsubaki et al. ..... 399/45
2003/0020968 A1 * 1/2003 Dan

FOREIGN PATENT DOCUMENTS

JP 54098252 A * 8/1979 ..... G03G/15/20
JP 01267582 A * 10/1989 ..... G03G/15/20
JP 02301759 A * 12/1990 ..... G03D/13/00
JP 2001282041 A * 10/2001 ..... G03G/15/20
JP 2001356631 A * 12/2001 ..... G03G/15/20
JP 2002202684 A * 7/2002 ..... G03G/15/20

* cited by examiner

*Primary Examiner*—Susan Lee
(74) *Attorney, Agent, or Firm*—Lawrence P. Kessler

(57) ABSTRACT

Internally-heated external rollers transfer heat rapidly to a fuser roller in an electrostatographic printer. Stored media process set points, input image content, and input media type data are used to regulate the heat transfer rate by varying the nip width between the heated external rollers and the fuser roller. The rate of heat transfer and the rate of heat transfer adjustment are sufficiently rapid that many different media weights and types may be mixed in a print run without restrictions on media run lengths, without collation requirements per run, and without productivity losses due to slowing of feed rate for heavier receivers.

17 Claims, 4 Drawing Sheets

ROLLER FUSER SYSTEM WITH INTELLIGENT CONTROL OF FUSING MEMBER TEMPERATURE FOR PRINTING MIXED MEDIA TYPES

FIELD OF THE INVENTION

The invention relates in general to the fuser used electrostatographic printing process, and in particular to the control of temperature of roller fusing members.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser station can include a roller, belt, or any surface having a suitable shape for fixing thermoplastic toner powder to the receiver.

The fusing step in a roller fuser commonly consists of passing the toned receiver between a pair of engaged rollers that produce an area of pressure contact known as a fusing nip. In order to form the fusing nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a DocuTech 135 machine made by the Xerox Corporation. The other uses a compliant fuser roller to form the nip against a hard or relatively non-conformable pressure roller, such as in a Digimaster 9110 machine made by Heidelberg Digital L.L.C. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable elastomeric coating, typically less than about 1.25 mm thick. A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers, which typically include polymeric materials made from elastomers.

One common type of fuser roller is internally heated, i.e., a source of heat for fusing is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller which is internally heated near its surface is disclosed by Lee et al. in U.S. Pat. No. 4,791,275, which describes a fuser roller including two polyimide Kapton RTM sheets (sold by DuPont® and Nemours) having a flexible ohmic heating element disposed between the sheets. The polyimide sheets surround a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Young's modulus of about 3.5 GPa–5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F.

An externally heated fuser roller is used, for example, in an Image Source 120 copier, and is heated by surface contact between the fuser roller and one or more external heating rollers. Externally heated fuser rollers are also disclosed by O'Leary, U.S. Pat. No. 5,450,183, and by Derimiggio et al., U.S. Pat. No. 4,984,027.

A compliant fuser roller may include a conformable layer of any useful material, such as for example a substantially incompressible elastomer, i.e., having a Poisson's ratio approaching 0.5. A substantially incompressible conformable layer including a poly(dimethyl siloxane) elastomer has been disclosed by Chen et al., in the commonly assigned U.S. patent application Ser. No. 08/879,896, now U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles which are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset (i.e., toner powder transfer to the fuser roller) in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient conformable layer. The extent of the contact area helps establish the length of time that any given portion of the toner image will be in contact with, and heated by, the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

In a roller fusing system, the fusing parameters, namely the temperature, nip-width, and speed of the fusing member, are fixed and controlled within certain specifications for a given range of receivers. Generally the system changes the temperature or/and speed according to the receiver weights or types. The changing of temperature in an internally heated fuser roller takes time to stabilize. If the receivers are presented at a too-rapid rate, the fuser roller may not have returned to its working temperature when the next receiver arrives. Consequently, the receivers must be stopped or slowed until the temperature of the fuser roller has come within acceptable range and such stopping or slowing results in degradation of receiver throughput rate. The same is true for speed changes. Regardless of whether the speed of presentation or the fuser roller temperature itself is being adjusted by the system, the temperature stabilization time required by a fusing member can constrain the speed of presentation of receivers.

The fixing quality of toned images of an electrophotographic printer depends on the temperature, nip-width, process speed, and thermal properties of the fusing member, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing member are optimized for the most critical case.

Complicating the system's design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperature is adjusted higher from the nominal, for heavier receivers and lower for lighter receivers. For some heavy receivers, the speed must also be reduced.

The change of fuser temperature and/or reduction of speed results in reduced productivity. Furthermore, if different receiver types are required in a single document, extra time is needed to collate images on different receivers into the document.

A digital printer with multiple paper supplies allows running RIPPED information that varies from image to image onto multiple receivers in a single document run. Since the RIPPED image may vary from one occurrence to the next, both in image color and image density, the workload on the fuser may vary significantly. U.S. Pat. No. 5,956,543, issued to Aslam et al. optimizes the image fixing of toned images on a specified receiver by optimally selecting the fuser temperature, nip-width and speed. However, it does not address the image fixing quality issues when multiple types and weights of receivers are mixed during a document mode operation of an electrophotographic printer.

SUMMARY OF THE INVENTION

The invention uses internally-heated external rollers to transfer heat rapidly to a fuser roller in an electrophotographic printer. The invention uses stored media process set points, input image content, and input media type data to regulate the heat transfer rate by varying the nip width between the heated external rollers and the fuser roller. The rate of heat transfer and the rate of heat transfer adjustment are sufficiently rapid that the invention allows mixing of many different media weights and types in a print run without restrictions on media run lengths, without collation requirements per run, and without productivity losses due to slowing of feed rate for heavier receivers.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
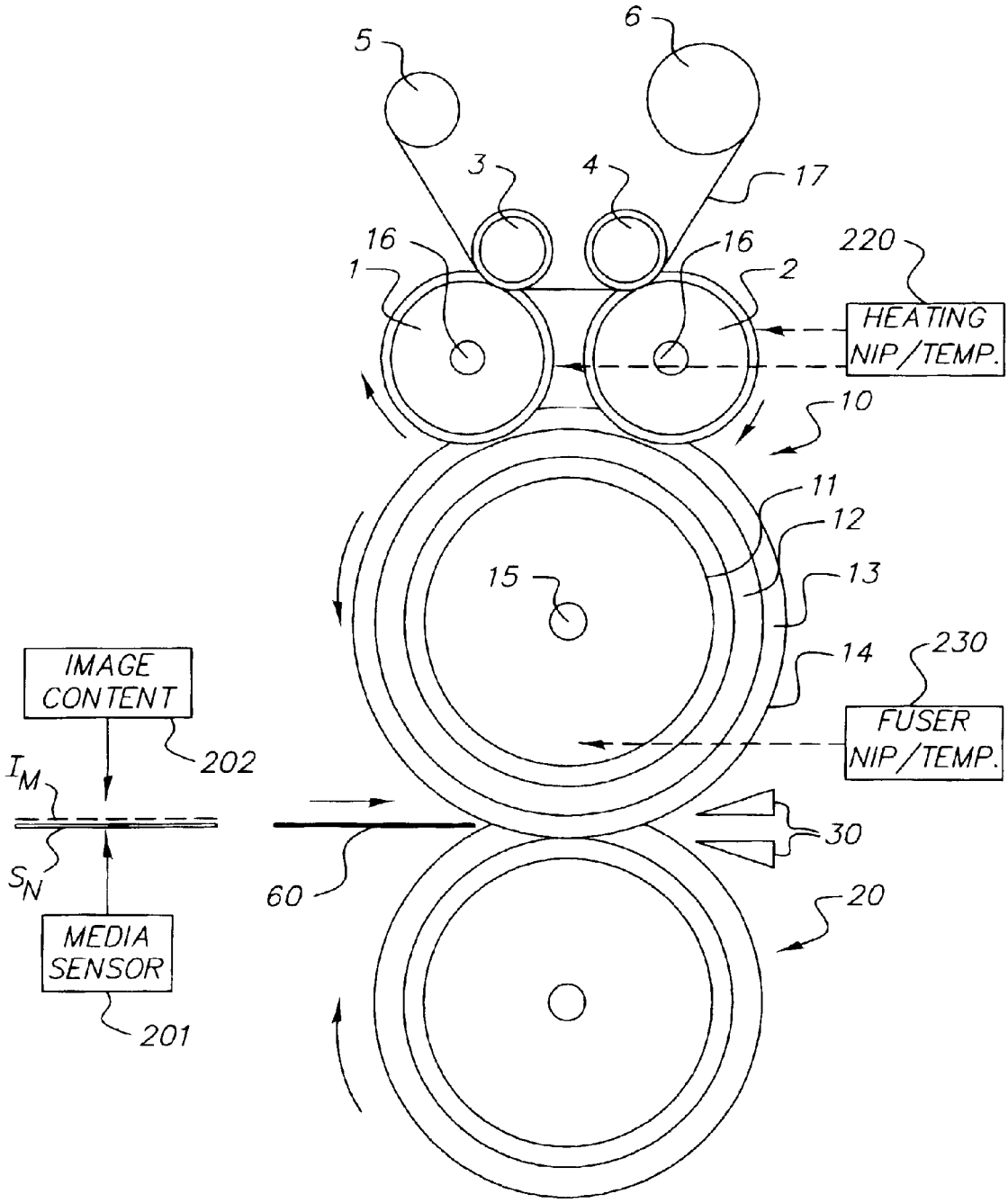
FIG. 1 shows a schematic of the fuser assembly according to this invention.

A schematic sketch of the fuser assembly disclosed in this invention is shown in FIG. 1. The fuser assembly includes a fusing member roller 10 and a pressure roller 20. Fusing member roller 10 is heated with an internal heat source 15 (lamp) and external heating rollers 1 and 2. The number and sizes of external heating rollers and the sizes of the fusing member rollers 10 and 20 depend on the printer process speed and the heat requirements for proper image fixing. Any toner or paper dust contamination on the heating members 1 and 2 is cleaned with a cleaning web 17 trained around takeup and supply rollers 5 and 6 respectively and corresponding back up rollers 3 and 4. In alternative embodiments, the cleaning is accomplished by other mechanisms well-known in the art, such as blade cleaning or tacky rollers for example.

The receiver (sheet) release from the fusing member rollers 10 and 20, is accomplished by a pair of air knives 30. In alternative embodiments of the invention, mechanical pawls or skive fingers for example, are utilized for receiver stripping, replacing the air knives. Further, toner offset prevention is accomplished by application of a release fluid to the fusing member rollers. The release fluid applicator is not shown in the diagram, but either a donor roller type or a web type applicator may be employed.

The fusing member roller 10 includes an aluminum core 11, an elastomeric base-cushion 12 (relatively more compliant than the pressure roller), a conductive elastomeric intermediate layer 13 (5 to 10 mils thick depending on the process speed), and finally a thin (1–2 mil) top release coating 14. The external heating rollers 1, 2 are conductive metallic (steel, aluminum, etc.) cores with finished metalized hard surface such as chrome, nickel, anodized aluminum, etc. Other embodiments of the external heating rollers use conductive Teflon® based coatings on the respective conductive cores.

The external heating rollers 1, 2 are heated with internal lamps 16. A predetermined desired temperature of fusing member roller 10 is maintained by an internal heat lamp 15 during the standby mode when external heating rollers 1, 2 are not engaged. The heat input for fusing of toner comes mainly from external heating rollers 1, 2 to the fusing member roller 10 during the print mode. A limited amount of additional heat comes from the fusing member's internal heat source 15 as a thermal ballast during the print mode to keep the core of the fusing member roller 10 within the desired predetermined temperature range.

Figure 6:
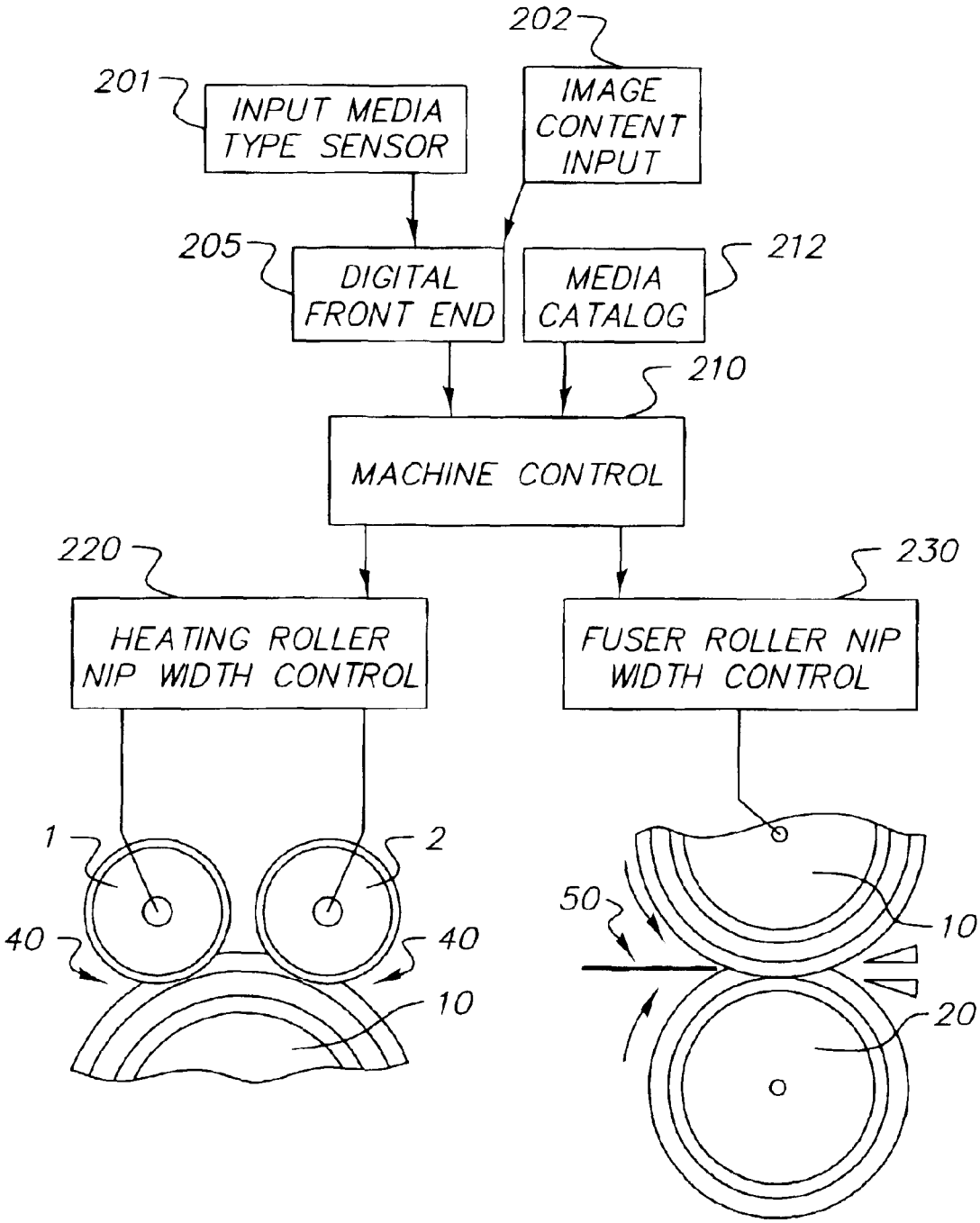
FIG. 6 shows a block diagram of the fuser control mechanism according to this invention.

A sheet $S_n$ bears a toner image $I_n$. As indicated in FIG. 6, the toner content of the image and the type of media that receives the image are provided to the digital front end 205 associated with the printer. The digital front end 205 and media catalog 212 provide the printer machine control 210 with signals representing respectively image content, and type of media and parameters of such media type being used. For quality control purposes, the apparatus has a media sensor 201 that senses the type and weight of the sheet $S_n$ and an image content sensor 202 senses the amount of toner that forms the image, $I_n$. The heating roller controller 220, associated with the machine control 210, controls the nip between rollers 1, 2 and 10 as well as the temperature of each heating roller 1, 2. The fuser roller nip width controller 230, associated with the machine control 210, controls the temperature of roller 10 and the nip between rollers 10 and 20.

Figure 2:
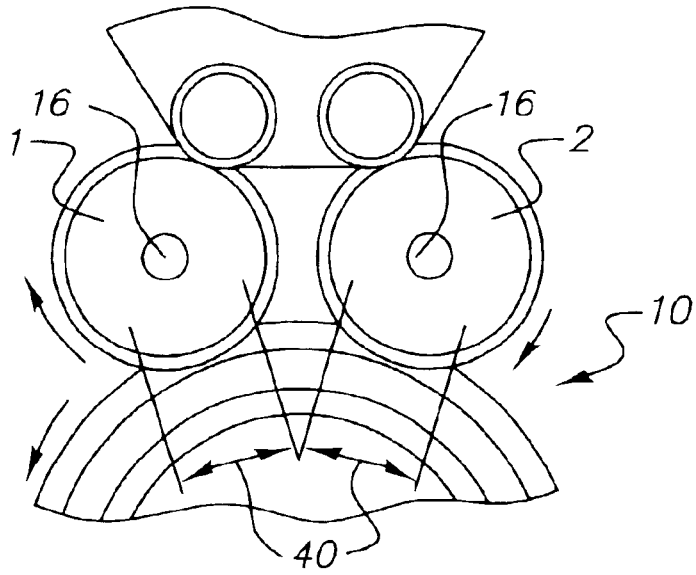
FIG. 2 shows the heating rollers and the fuser roller, and the nips between them, for the fuser assembly of FIG. 1.
Figure 5:
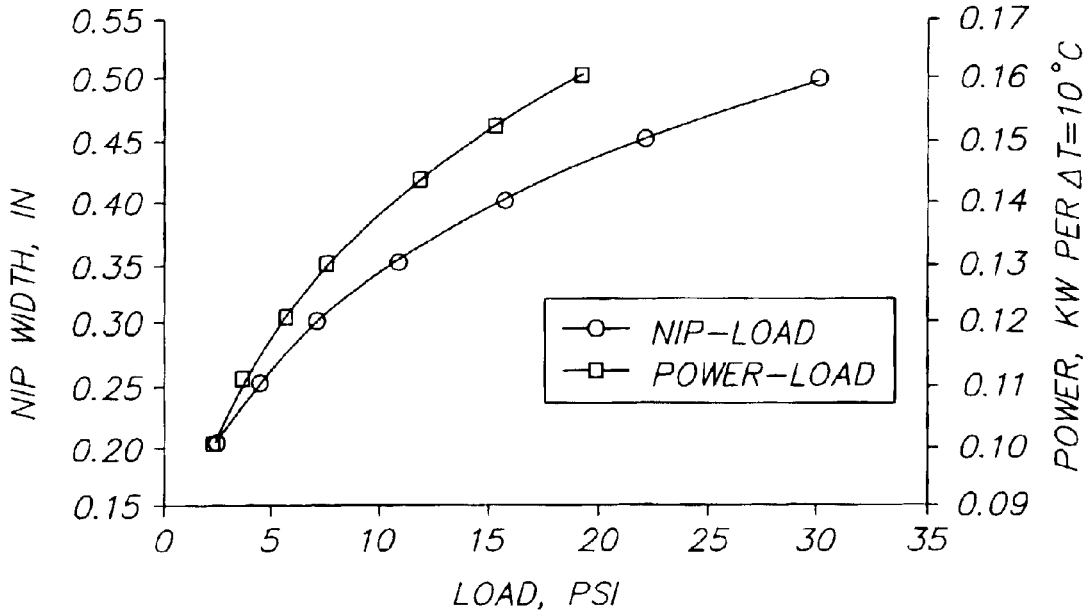
FIG. 5 shows a graph of the relationship between the applied load and nipwidth, according to this invention, giving the power transferred at different levels of load.

The fuser assembly according to this invention adjusts the fuser member roller 10, temperature to various set-points by changing the nip width 40 (see FIG. 2) or contact time between the heating rollers 1, 2 and the fuser member roller. The temperature of the heating rollers 1 and 2 is maintained constant, but the heat input to the fusing member roller 10 is controlled by the nip width (dwell time) 40 between the heating rollers and the fuser member roller. The graph of FIG. 5 shows an example of the relationship between the applied load and nipwidth and corresponding power that can be transferred to the fuser roller for every 10° C. temperature difference between the heating rollers and the fuser member roller.

The fuser assembly according to this invention also applies print engine intelligence as referred to above. The fuser process set-points (fuser nipwidth, fuser member temperature, and energy requirements) for various types of media are stored as lookup tables in a media catalog 212 for the machine control unit 210 (see FIG. 6). The media can include heavy stock cover material, interior page print material, insert material, transparency material, or any other desired media to carry text or image information. A typical machine control unit 210 includes a microprocessor and memory or microcomputer. It stores and operates a program that controls operation of the machine in accordance with programmed steps and machine inputs, such as temperature of the fusing rollers. Temperature data is supplied, for example, by a thermocouple (not shown) or any other suitable thermal sensor in a manner well known to those skilled in the art. As a sheet of a specific media type is requested, the DFE 205 provides a data signal to the machine control unit 210 (or alternatively, directly to an independent control for the fuser assembly) that is representative of the image contents and the type of media sheet coming to be fixed. The machine control unit 210 sets the fuser conditions (temperature; dwell time) from the media catalog 212 as a function of the data provided by the DFE 205. Machine control unit 210 directs the heating roller nip width control 220 for heating rollers 1, 2 to adjust the nipwidth 40 according to the power requirements of the fusing member roller 10 per the information provided from media catalog 212. Machine control unit 210 also directs the fuser roller nip width controller 230 for fusing member 20 to adjust the fuser nip 50 per the information provided from media catalog 212.

Figure 3:
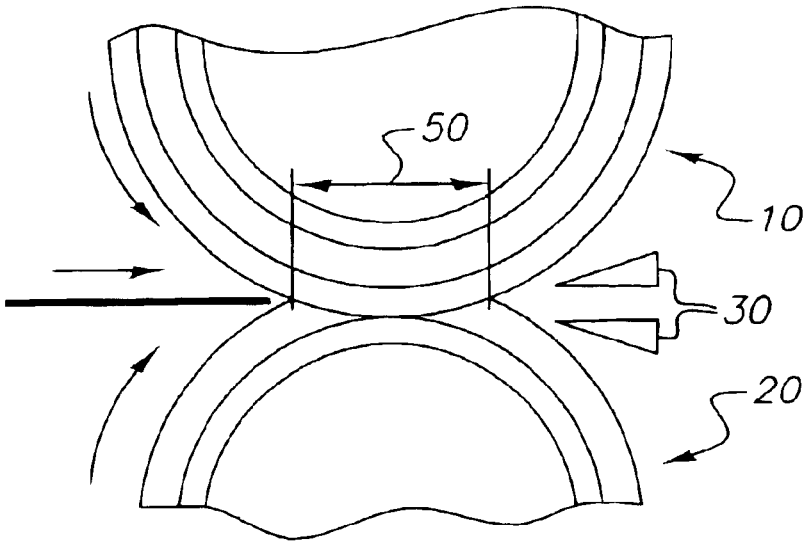
FIG. 3 shows the fuser roller and the pressure roller, and the nip between them, for the fuser assembly of FIG. 1.

The energy in the fuser roller 10 is stored only in its top coating and the conductive intermediate layer (5–10 mils). See FIG. 3 and FIG. 6. Therefore, after the passage of each sheet through the fuser nip 50, the fuser surface temperature drops significantly and heat energy needs to be restored back in the fusing member roller 10 by the heating rollers 1, 2 during their contact time. Since the heating rollers 1, 2 are made of thermal conductive materials; the heat transfer rate to the fuser member roller 10 is quite fast. As one media type is followed by a different media type, the machine control unit 210 is informed of the different types and it loads the corresponding fuser setup conditions from the media catalog 212. Consequently the fuser nip 50, as well as fuser member temperature (driven by the nipwidth 40) is adjusted to the correct value during the inter-frame between two sheets. Both controllers 220 and 230 change the respective nips 40 and 50 dynamically, in any well known manner, during the inter-frame between two sheets.

Each nip control may include a cam and a stepper motor for a fixed displacement nip, a set of air regulated cylinders for constant load nip, a combination of both, or any combination of these and other electro-mechanical mechanisms well-known in the art. Since the temperature of the fusing roller (as driven by the heating rollers nip) and the nipwidth between the fusing and pressure members can be manipulated and adjusted for each sheet, such a fusing assembly system allows mixing of many different media weights and types seamlessly without any restriction on the run length of each media.

In distinct embodiments of the invention, the fusing member may be in the form of a roller, a belt or a sleeve, or variations thereof as are well-known in the art.

Figure 4:
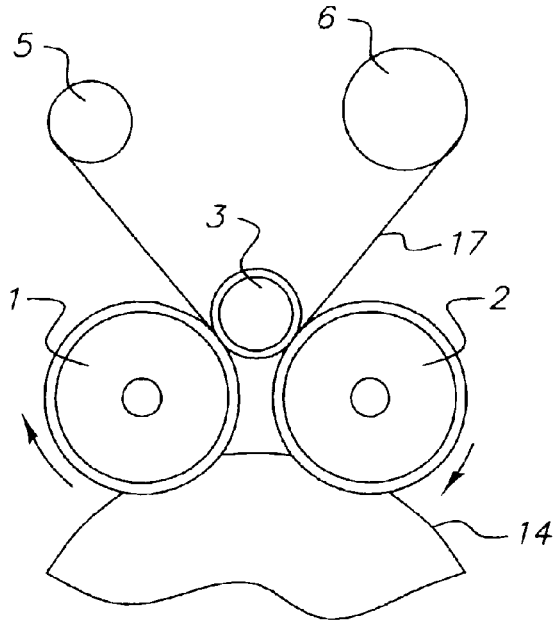
FIG. 4 shows a fuser roller with a single backup roller.

In a further embodiment of the invention (see FIG. 4), the cleaning web 17 may be placed in contact with the external heating rollers 1, 2 using only a single back up roller 3.

The invention confers the advantage of enabling the printer to run jobs in document mode while mixing a variety of receivers, without loss of productivity or fusing quality. The invention also facilitates seamless printing on the widest possible ranges of media types and weights.

Those skilled in the art understand that the functional elements of the sensor 201, 202 and the controllers 220, 230 may be implemented in different ways. In lieu of actual sensors, the machine may be pre-set for specific media types, weights and toner content. Likewise, the controllers 220, 230 may use electric stopper motors, hydraulics or pneumatic operators and other equivalent means to move the rollers and set the nips.

The invention has been described in detail with particular reference to certain preferred embodiment thereof, but it will be understood that variations and modifications can be effected within the spirit and scope of the invention.

PARTS LIST

1) external heating roller
2) external heating roller
3) back up roller
4) back up roller
5) take up roller
6) supply roller
10) fusing member roller
11) aluminum core
12) base-cushion
13) conductive elastomeric layer
14) top release coating
15) internal heat source
16) internal lamp
17) cleaning web
20) pressure roller
30) air knives
40) nip width
50) fuser nip
201) media sensor
202) image content sensor
205) digital front end (DFE)
210) machine control unit
212) media catalog
220) heating roller controller
230) fuser roller nip width controller

What is claimed is:

1. An electrostatographic printer with a roller fusing apparatus comprising:

a heated fusing member for fusing toner to sheets of receiver media;

one or more external heating members in heat transfer contact with said heated fusing member;

a pressure member in contact with the heated fusing member to form a fusing nip therebetween;

a machine controller for changing fusing nip widths in accordance with the type of receiver media and the image on the media;

a heating member contact controller associated with the machine controller, for changing contact width between the external heating members and the heated fusing member; and a pressure member nip controller associated with the machine controller, for changing nip width between the pressure member and the heated fusing member.

2. The apparatus of claim 1, wherein the one or more external heating members are rollers, which contain an internal heating source.

3. The apparatus of claim 1, wherein the heated fusing member contains an internal heating source.

4. The apparatus of claim 1, further including a fusing member cleaner;

including a cleaning web trained around a supply roller and a takeup roller; and one or more back up rollers placing the cleaning web in rub contact with each external heating member.

5. The apparatus of claim 1, further comprising air knives for stripping receiver media with fused toner from said fusing member and said pressure member.

6. The apparatus of claim 1, further comprising mechanical pawls for stripping receiver media with fused toner from said fuser member and said pressure member.

7. The apparatus of claim 1 further comprising skive fingers for stripping receiver media with fused toner from said fusing member and said pressure member.

8. The apparatus of claim 1, wherein the fusing member comprises an internally heated fuser roller.

9. The apparatus of claim 1, wherein said internally heated fuser roller comprises:

an aluminum core;

an elastomeric base-cushion;

a conductive elastomeric intermediate layer; and a thin top release coating.

10. The apparatus of claim 1, wherein each external heating member comprises:

a conductive metallic core; and a finished hard surface.

11. The apparatus of claim 10, wherein said conductive metallic core comprises steel.

12. The apparatus of claim 10, wherein said conductive metallic core comprises aluminum.

13. The apparatus of claim 10, wherein said finished hard surface comprises chrome.

14. The apparatus of claim 10, wherein said finished hard surface comprises nickel.

15. The apparatus of claim 10, wherein said finished hard surface comprises anodized aluminum.

16. The apparatus of claim 14, wherein said finished hard surface comprises a conductive fluorine-containing resin-based coating.

17. A method for fusing toner to sheets of receiver media in an electrostatographic printer, comprising for each arriving sheet of receiver media the steps of:

providing a set of first data signals respectively representative of characteristics of sheets of receiver media;

providing second data signals representative of a particular type of sheet of arriving receiver media so that a selection can be made of corresponding first data signals;

providing third data signals representative toner density for an image on an arriving sheet of receiver media;

selectively heating a fusing member to bring the fusing member to a desired temperature for heat transfer of toner to a receiver media in accordance with at least one of the second or third data signals;

selectively adjusting pressure between a receiver media and the fusing member in accordance with at least one of the second or third data signals;

fusing the toner to the sheet of receiver media by a fusing member including one or more internally heated rollers heated by one or more external heating rollers, during an interframe interval before the arrival of each sheet of receiver media, wherein the nip width between the external heating rollers and the internally heated roller are adjusted to vary the amount of heat transferred from the external heating rollers to the internally heated roller; and stripping the sheet of receiver media from the fusing member.

* * * * *